United States Patent [19]

Rushing et al.

[11] 4,411,095

[45] Oct. 25, 1983

[54] BUBBLE PIPE

[75] Inventors: Wilford A. Rushing; Barbara R. Rushing, both of Bloomington, Ill.

[73] Assignees: Rosemary E. Boelke; Art Boelke, both of Charlotte, N.C.

[21] Appl. No.: 346,215

[22] Filed: Feb. 5, 1982

[51] Int. Cl.[3] ..... A63H 33/28

[52] U.S. Cl. ..... 46/7; 131/226

[58] Field of Search ..... 46/6, 7; 131/176, 177, 131/178, 226, 224, 193

[56] References Cited

U.S. PATENT DOCUMENTS

| | | | |
|---|---|---|---|
| 1,576,287 | 3/1926 | Larsen | 46/6 |
| 2,542,100 | 2/1951 | Sturm, Jr. | 46/6 |
| 3,183,621 | 5/1965 | Allen, Jr. | 46/6 |
| 3,340,647 | 9/1967 | Lathrop | 46/228 |
| 3,443,337 | 5/1969 | Ehrlich | 46/6 |

FOREIGN PATENT DOCUMENTS

| | | | |
|---|---|---|---|
| 699916 | 2/1931 | France | 131/224 |
| 1840 | of 1875 | United Kingdom | 131/226 |

*Primary Examiner*—Mickey Yu

*Attorney, Agent, or Firm*—Harvey B. Jacobson

[57] ABSTRACT

A pipe shaped device is provided including a bowl and an elongated hollow pipe stem having a mouth insertable portion at one end, a passage extending longitudinally thereof and with the other stem end formed integrally with and opening into a lower portion of the interior of the bowl. An apertured insert or cover extends across the interior of the bowl for retaining particulate bar soap material to be mixed with water in the bowl and for creating bubbles when air is forced through the mixture and the openings in the apertured insert or cover. The bowl includes an external annular groove seatingly receiving an annular shield and the shield functions to retain the down flow of soap bubbles exiting from the top of the bowl. Particulate soap material is received and collected in the bowl by scraping bar soap thereacross. A threadedly secured member within the bowl secures the apertured insert in place.

1 Claim, 3 Drawing Figures

FIG. 1
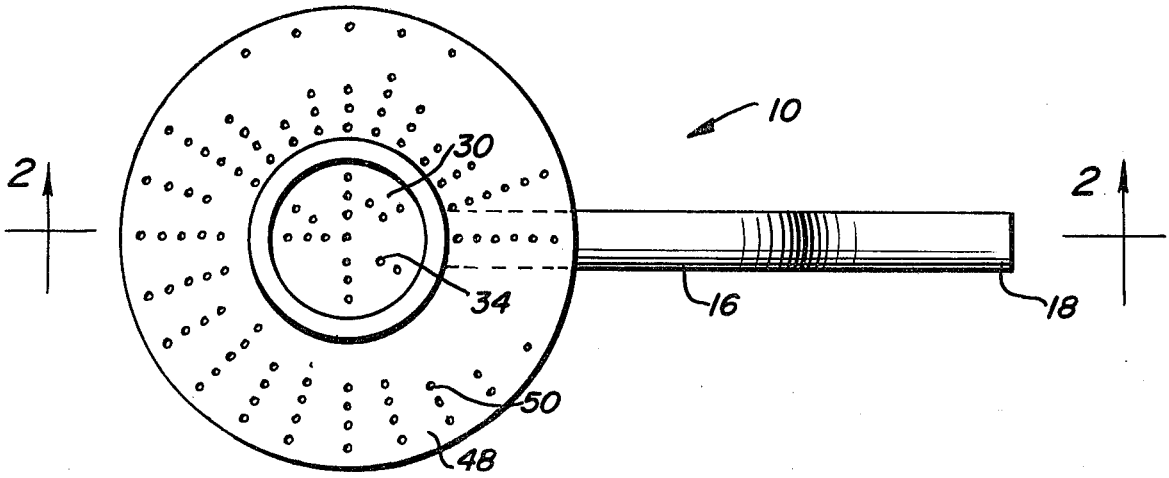
FIG. 2
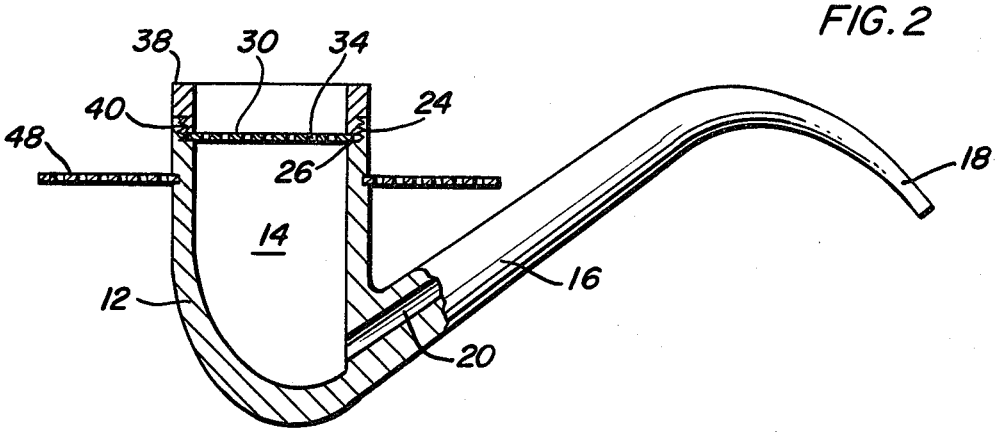
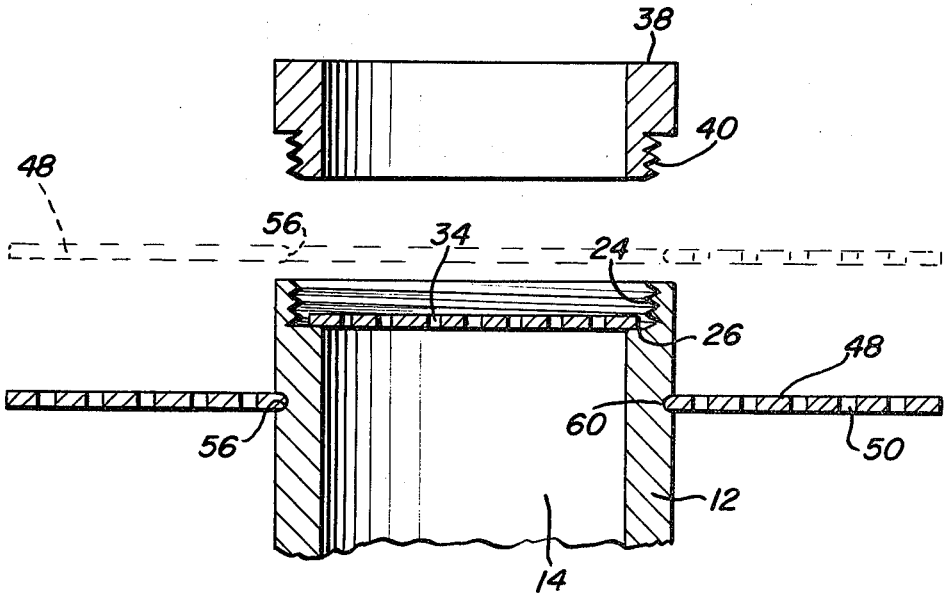
FIG. 3

BUBBLE PIPE

BACKGROUND OF THE INVENTION

The present invention relates to a bubble pipe which uses water and bar soap in particulate form retained in the bowl by an annular apertured insert rather than conventional means using liquid bubble pipe fluids, and more particularly the invention relates to a bubble pipe device having an apertured insert extending across an interior area of the bowl for retaining particulate bar soap material therein for mixing with water in the bowl and creating bubbles together and an exterior shield is provided on the bowl for retaining down flow of soap bubbles exiting from the upper end of the bowl. The invention particularly relates to a bowl for a bubble pipe having an interior apertured insert for the bowl which is retained in place by an annular threaded member, and in which the top of the bowl is capable of being scraped across a bar of soap three or four times to form chips or slivers of bar soap which are deposited in the bowl with a few drops of water being added to the pipe bowl which interacts with the soap and air being forced therethrough from the pipe stem for forming bubbles. An annular shield is snap fitted about the exterior of the bowl for catching bubbles flowing down from the bowl thereby providing additional collection and arraying of the bubbles about the shield for display.

FIELD OF THE INVENTION

There are many bubbles pipes which are capable of use with liquid soap material, but none has been found which provides use and enjoyment in generating or creating bubbles from conventional bar soap. Further, most pipes do not provide means for retaining and elongating the time of bubble retention during the course of blowing bubbles. According to the present invention a shield exterior of the bowl provides for limited down flow and collection of the bubbles and an annular apertured insert retained by annular threaded means provides for placement of and retention of soap granules, slivers, chips and the like from the bar soap within the bowl.

DESCRIPTION OF THE PRIOR ART

Various patents are known relating to bubble forming devices such as the following U.S. Pat. Nos.: 1,020,708 T. J. Marshall; 1,576,287 R. Larsen; 2,305,382 C. H. Hagopian; 3,219,427 J. B. Hymowitz; 3,952,447 W. E. Hackell.

None of these patents bears upon the invention of the claims of the present application.

SUMMARY OF THE INVENTION

An object and advantage of the present invention is to provide a useful and entertaining bubble pipe usable with bar soap and having means for extending the time retention of bubbles formed by the pipe.

Another object of the present invention is to provide a bubble pipe having removable components which can be removed to enable the top of the bowl to be scraped across a bar of soap for collecting bits of soap therein which, when combined with air blown through the pipe bowl and water in the bowl, form bubbles which extend over the bowl and are collectively retained by a shield plate with the removable components being in place and retaining the soap in the bowl.

A still further object of the present invention is to provide an apertured insert for a bubble pipe which is mounted upon an annular ledge within the pipe bowl and removably retained thereon by means of an externally threaded annular member engaging an internally threaded portion of the pipe bowl.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a top plan view of a bubble pipe device according to a preferred embodiment of the present invention.

FIG. 2 is a partial sectional view taken generally along line 2—2 of FIG. 1.

FIG. 3 is an exploded sectional view of the annular threaded member, the apertured cover for the bowl and the annular shield structure embodying the present invention.

DESCRIPTION OF A PREFERRED EMBODIMENT

Referring now to the drawings, there is shown a bubble pipe device in the form of a pipe shaped body 10 having a bowl 12 generally hollow throughout for forming a bowl space 14 and which communicates at the bottom thereof with an integral pipe stem 16 terminating in a mouth insertable portion 18, and through which stem a hollow communicating space or passage 20 extends throughout the entire length of the pipe stem 16 communicating the mouth insertable portion 18 and space 14. An upper and free circumferential portion of the bowl 12 is provided with an annular internally threaded portion 24 positioned immediately above an annular ledge or shoulder 26. On the annular ledge, there is received a circular apertured insert or plate 30 extending across the entire hollow space 14 of the bowl 12. The insert 30 may be constructed of plastic material and is provided with apertures 34 throughout its area. The insert 30 is retained on the shoulder 26 by an annular externally threaded top member 38 having a threaded portion 40 engaging the threaded portion 24 of the bowl 12 and which forms the top portion thereof.

A shield 48 in the form of an annular plate having an array of apertures 50 is mounted on the bowl 12 by a central opening formed by an inner radius or edge 56 received in an annular recess or groove 60 on the bowl 12. The shield 48 is constructed of plastic material having some measure of resiliency as well as flexibility which enables the shield 48 to be manually pressed downwardly on the bowl 12 until it reaches the annular groove 60 where it then snaps into the groove.

When using the bubble pipe, the threaded top member 38 is removed along with insert 30. The top of the bowl 12 as defined by the upper end of the threaded portion 24 is scraped across a bar of soap, preferably when dry, so that soap slivers, chips or bits will be scraped off the bar of soap and deposited in the bowl 12. The insert 30 and top member 38 are replaced and a small quantity of water is added to the bowl. Then by blowing air through the passage 20 in the pipe stem 16 in a conventional manner, bubbles will be formed at the top of the bowl.

The apertures 34 in the insert 30 will enable a plurality of small bubbles to be formed and in some instances a large bubble can be formed which includes a plurality of connected small bubbles thus enhancing the appearance and entertainment characteristics of the bubble pipe. The shield 48 serves to support and retain bubbles that are formed by the bubble pipe with surface tension between the bubbles and the large surface area of the shield enhancing the bubble retention characteristics. Also, the shield can be used to pick up already formed bubbles disposed on the surface of water in a bath tub or the like with the bubble pipe enabling children to obtain enjoyment while bathing thereby encouraging cleanliness. By such use, the bubble pipe can be designated as a "bubble-me-clean" pipe thus further enhancing its use in developing desirable cleanliness habits. The entire pipe may be constructed of plastic material of attractive colors and, if desired, a simple check valve assembly may be incorporated into the passage 20 to prevent a child from sucking soapy water into its mouth when using the bubble pipe.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A bubble pipe device including an upwardly opening bowl and an elongated hollow stem having one end formed integrally with the lower end of the bowl and opening thereinto and the other end extending laterally outwardly from the bowl and adapted to be received in the mouth of a user, said bowl including an upper end internally threaded and enlarged annular portion defining an upwardly facing annular shoulder at the inner extremity thereof, a circular apertured insert plate removably received in said enlarged annular portion and seated on said shoulder, an externally threaded annular retaining member removably threaded into said enlarged annular portion above said plate and retaining the latter against removal from said enlarged annular portion, the threads in said enlarged annular portion extending upwardly through the upper periphery of said bowl and adapted, when said retaining member is removed, to facilitate the scraping of thin slivers of soap from a bar of soap scraped over the upper end of said bowl, said bowl including a peripheral groove formed in and extending about the exterior of said bowl, an apertured annular shield downwardly displaceable over the upper end of said bowl and removably snap fittingly engageable in said groove for retaining the down flow of soap bubbles exiting from the upper end of said bowl.

* * * * *